United States Patent [19]

Lee

[11] 4,129,918

[45] Dec. 19, 1978

[54] ADJUSTABLE SLEEVE FOR ARTISTS PAINT BRUSHES

[76] Inventor: Robert Lee, 41-12 29th St., Long Island City, N.Y. 11101

[21] Appl. No.: 828,894

[22] Filed: Aug. 29, 1977

[51] Int. Cl.[2] ..... A46B 9/10

[52] U.S. Cl. ..... 15/169; 15/184

[58] Field of Search ..... 15/168, 169, 171, 246, 15/248, 435, 443, 184; 206/361; 401/15, 280, 290

[56] References Cited

FOREIGN PATENT DOCUMENTS 3472 5/1891 Switzerland ..... 15/443

18260 of 1908 United Kingdom ..... 15/169

23970 of 1908 United Kingdom ..... 15/443

*Primary Examiner*—Peter Feldman

*Attorney, Agent, or Firm*—Stoll and Stoll

[57] ABSTRACT

An adjustable sleeve for artists' paint brush adapted to adjust the effective length of the hair or bristles. The adjustable sleeve is tubular at its tip to contain the hair or bristles and which is split above the tip to provide a spring biased grip upon the brush ferrule. The adjustable sleeve is tapered in substantial conformity with the taper of the ferrule and it is longitudinally adjustable relative to the ferrule to vary the effective length of the hair or bristles.

5 Claims, 14 Drawing Figures

ADJUSTABLE SLEEVE FOR ARTISTS PAINT BRUSHES

BACKGROUND OF THE INVENTION

1. Field of the Invention

This invention relates to artists' brushes and, in particular, but not exclusively, to relatively expensive professional brushes.

2. Description of the Prior Art

The closest prior patent art known to applicant consists of the following U.S. Pat. Nos.:

987,277, Wright;
2,513,930, Goldrich;
2,558,191, Nightingale;
2,662,240, Perkins;
3,193,863, Myers et al;
3,341,879, Kumpman.

The closest of these patents is believed to be Myers U.S. Pat. No. 3,193,863. However, this patent does not relate to means for adjusting conventional paint brushes. Instead, it provides a special construction throughout, both the brush and the adjusting means being of special design. Instead of an adjustable sleeve movable relative to the brush, Myers provides movement of the brush hair or bristles relative to the ferrule.

Perkins U.S. Pat. No. 2,662,240 does show an attachment to a conventional brush but the function of the Perkins patent is to change the shape of the bristles.

SUMMARY OF THE INVENTION

The present invention provides an adjustable sleeve which is adapted to be applied to conventional artists' paint brushes. The lower tip of this adjustable sleeve is tubular to confine the hairs or bristles. Above the tubular tip, this adjustable sleeve is longitudinally split to provide a clip formation capable of adjusting to conventional ferrule dimensions. The sleeve is tapered to conform to the taper of the brush ferrules and the split body of the sleeve, above the tubular tip, provides the necessary adjustment to compensate for the taper of the ferrule. The adjustable sleeve is made of spring material for tensioned engagement with the ferrule in order to hold the adjustable sleeve in whatever adjusted position it is placed.

The adjustable sleeve of the present invention may be made of any suitable spring material such as spring steel, spring brass or beryllium copper or any other spring metal. Spring plastics may also be used, that is, plastics with sufficient resilience and memory to function substantially in the manner of spring metal.

The purpose of the tubular tip of the adjustable sleeve is to properly confine and control the hairs or bristles. The split body of the adjustable sleeve above the tubular tip is to provide a spring clip action for adjustably securing the adjustable sleeve to the fixed ferrule on the brush. Another feature of considerable importance resides in the curved lip at the junction between the tubular tip and the split body. This curved lip helps to guide the hairs or bristles into the tubular tip, this being the section of smallest diameter and where it is most difficult to insert the hairs or bristles.

Another important function of the adjustable sleeve is to protect the hairs or bristles of artists' paint brushes when the brushes are not in use. The adjustable sleeve may be moved into a position wherein it fully encloses, and thereby protects, the hairs or bristles. The split body of the adjustable sleeve remains spring-clipped to the brush ferrule and thereby attached to the brush handle.

DESCRIPTION OF PREFERRED EMBODIMENTS OF INVENTION

Figure 1:
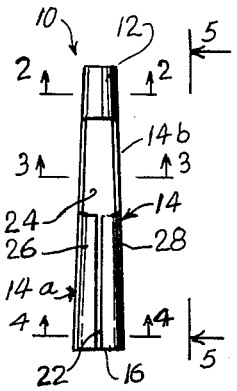
FIG. 1 is a face view of an adjustable sleeve made in accordance with a preferred embodiment of this invention.
Figure 2:
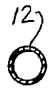
FIG. 2 is a transverse section on the line 2—2 of FIG. 1.
Figure 3:
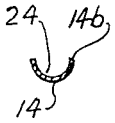
FIG. 3 is a transverse section on the line 3—3 of FIG. 1.

The simplest embodiment of the invention is shown in FIGS. 1–8 of the drawing. It will there be seen that adjustable sleeve 10 is a unitary device having a tubular tip 12 and a longitudinally split body 14 above the tip. The adjustable sleeve is shown to be tapered from a relatively small diameter at tip 12 to a relatively large diameter at the opposite end 16. It is this tapered configuration which enables the adjustable sleeve to conform to the taper of ferrule 18 of a conventional artists' paint brush 20.

It will be observed that the split body 14 of the adjustable sleeve comprises two major sections: an upper section 14*a* wherein the slit 22 is relatively narrow and lower section 14*b* where slit 22 opens into a relatively wide cutout 24. What is formed on opposite sides of relatively narrow slit 22 is a pair of wings 26 and 28 which perform the function of a spring clip. A cross sectional view of said upper body section (FIG. 4) shows it to have the configuration of a C-clip.

Figure 8A:
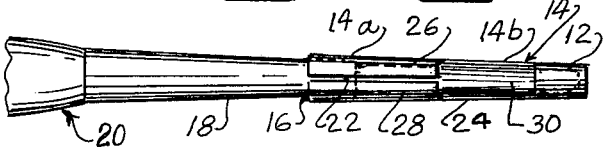
FIG. 8*a* is a view similar to that of FIGS. 6, 7 and 8, but showing the adjustable sleeve in its lowermost position on the brush, wherein the sleeve fully encloses the hair or bristle tip to protect same when not in use.
Figure 5:
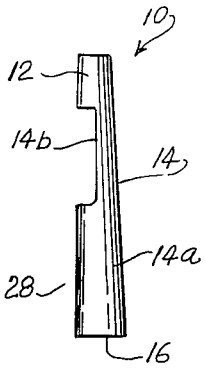
FIG. 5 is a side view of said adjustable sleeve looking in the direction of arrows 5,5 of FIG. 1.
Figure 6:
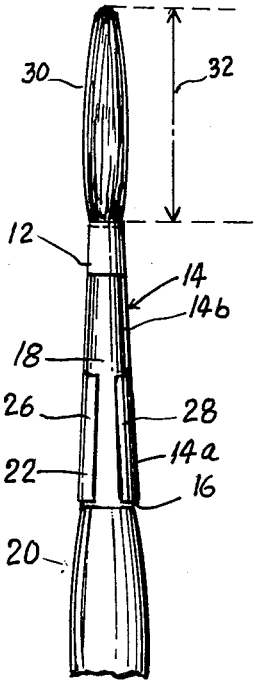
FIG. 6 is a view similar to that of FIG. 1 but showing the adjustable sleeve in operative position on an artists' paint brush, said adjustable sleeve being positioned to expose virtually the entire hair or bristle tip of the brush.
Figure 7:
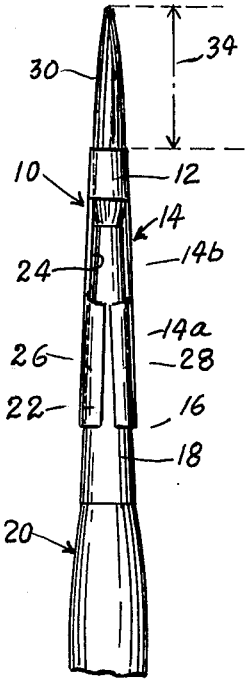
FIG. 7 is a view similar to that of FIG. 6 but showing the adjustable sleeve in an intermediate position on the brush wherein only half the length of the hair of bristle tip remains exposed.
Figure 8:
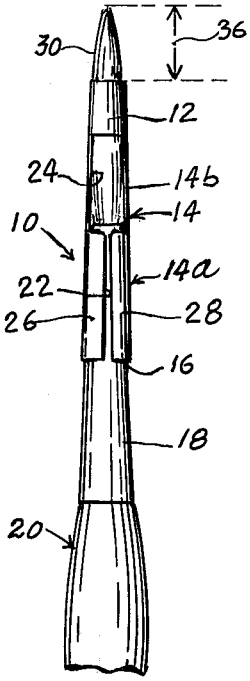
FIG. 8 is a view similar to that of FIGS. 6 and 7 but showing the adjustable sleeve at a relatively low position on the brush, with only a quarter of the length of the hair or bristle tip remaining exposed.
Figure 9:
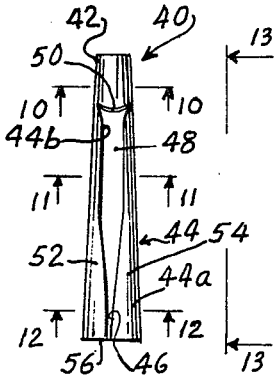
FIG. 9 is a view similar to that of FIG. 1 but showing a modified form of the adjustable sleeve herein claimed.
Figure 10:
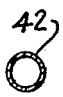
FIG. 10 is a cross sectional view through said modified adjustable sleeve, said view being taken on the line 10—10 of FIG. 9.
Figure 11:
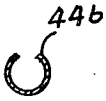
FIG. 11 is a cross sectional view through said modified adjustable sleeve, said view being taken on the line 11—11 of FIG. 9.
Figure 12:
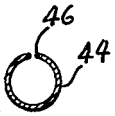
FIG. 12 is a third cross sectional view through said modified adjustable sleeve, said view being taken on the line 12—12 of FIG. 9.
Figure 13:
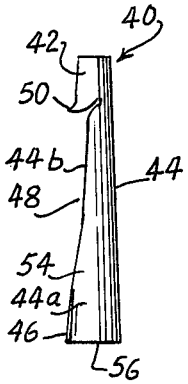
FIG. 13 is a side view of said modified adjustable sleeve, said view being shown in the direction of arrows 13, 13 of FIG. 9.

When adjustable sleeve 10 is slipped over the hairs or bristles 30 of brush 20 and onto ferrule 18 of said brush, the split body of the adjustable sleeve, by means of its wings, 26, 28, grips the ferrule and holds the sleeve at any selected or adjusted position on said ferrule, longitudinally thereof. FIGS. 6, 7 and 8 illustrate different operative positions of the adjustable sleeve on the ferrule. Thus, FIG. 6 shows the adjustable sleeve disposed in an upper position on the ferrule, thereby exposing virtually the entire tip of the brush hairs or bristles. In this position of the adjustable sleeve the effective length of the hairs or bristles, as indicated by arrows 32, is only slightly shorter than the full, actual length thereof. In FIG. 7 the adjustable sleeve is shown advanced to an intermediate position, exposing only approximately half of the length of the brush hairs or bristles. It is this exposed length, as depicted by arrows 34, which becomes the effective length of the hairs or bristles. FIG. 8 shows the adjustable sleeve advanced still farther to a lower position on the ferrule, leaving only about a quarter of the length of the hairs or bristles exposed. It is this quarter length, depicted by arrows 36, that now becomes the effective length of the hairs or bristles.

Figure 4:
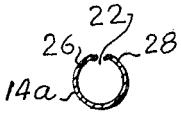
FIG. 4 is a transverse section on the line 4—4 of FIG. 1.

In each position of the adjustable sleeve, its C-clip formation as depicted in FIG. 4 effectively grips the ferrule under spring tension and prevents accidental or unintentional dislodgement of the adjustable sleeve relative to the ferrule. As has above been indicated, the conventional ferrule 18 of a conventional artists' brush 20 is tapered and the adjustable sleeve of the present invention is correspondingly tapered to provide a relatively snug fit. However, since the upper body section **14*a* of the adjustable sleeve comprises a spring biased C-clip, which is adapted to effectively grip the ferrule at any point along the range of its operative contact with the ferrule. Thus, the C-clip formation 14*a* of the adjustable sleeve will tensionally engage the upper portion of the ferrule as shown in FIG. 6, the intermediate portion of the ferrule as shown in FIG. 7 and the lower portion of the ferrule as shown in FIG. 8**.

Referring now to a modified embodiment of the invention as illustrated in FIGS. 9–13, adjustable sleeve 40 is a unitary element comprising a tubular tip 42 and a split body 44 extending upwardly from said tubular tip. The split body consists of two sections, an upper section **44*a* and a lower section 44*b*, said lower section being contiguous with the tubular tip 42. Upper section 44*a* has a relatively thin slit 46 which widens out to a relatively wide cutout 48 in the lower body section 44*b*. As FIG. 10 clearly shows tubular tip 42 is circular in cross section. As FIG. 11 clearly shows lower body section 44*b* is generally U-shaped in cross section. As FIG. 12 clearly shows, upper body section 44*a* is generally C-shaped in cross section and, as is the case with upper section 14*a* of the first form of this invention, upper body section 44*a*** comprises a spring clip of C-formation.

Further, as is the case with the first form of the invention, adjustable sleeve 40 is tapered to correspond to the taper of conventional ferrule 18 of conventional artists' paint brush 20. Thus tubular tip 42 has a relatively smaller diameter than upper body section **44*a*. As is the case with the first form of the invention, adjustable sleeve 40** is made of spring material such as spring steel or brass or other spring metal or, if desired, spring plastics. The invention is not limited to any particular type of plastics since there are so many that would be suitable for the needs of the adjustable sleeve. Nylon is a good material for this purpose but so are so many other plastics that are used for clip purposes, for example, wire harness clips and bicycle brake cable clips.

In two respects adjustable sleeve 40 differs from adjustable sleeve 10. The more important difference resides in the formation of a lip 50 at the upper end of tubular tip 42. This lip 50 flares radially outwardly and serves as a guide for the hairs or bristles when they are being inserted into the tubular tip 42. See FIG. 13. The other point of difference between the two adjustable sleeves resides in the configuration of the wing portions of the upper body sections. It will be seen that wing portions 52 and 54 of upper body section **44*a* are less pronounced than wing portions 26 and 28 of upper body section 14*a*. By the same token, slit 46 of upper body section 44*a* tends to widen out into cutout 48 almost from the very top end 56 of upper body section 44*a*. Slit 22, however, of upper body section 14*a* tends to remain constant in cross sectional dimension until it reaches the juncture of the upper and lower body sections 14*a*, 14*b***. This difference in configuration is a difference in design and is not intended to denote any difference in the basic principles of the invention.

Adjustable sleeve 40 may be applied to artists' paint brush 20 in precisely the same manner as adjustable sleeve 10 as shown in FIGS. 6, 7 and 8. What has been said concerning adjustable sleeve 10 in connection with FIGS. 6, 7 and 8 also applies to adjustable sleeve 40.

As has above been stated, the adjustable sleeve (either embodiment) may be used to protect the hairs or bristles when the brush is not in use. The length of the adjustable sleeve should be sufficient to fully enclose the hairs or bristles while the split body remains in spring-clipped engagement with the ferrule. Accordingly, the length of the adjustable sleeve should extend the length of the brush hairs or bristles plus sufficient length in the split body to securely clip onto the ferrule. By the same token, the smallest (relaxed) diameter of the split body should fall short of the smallest diameter of the ferrule in the area of engagement between them. See FIG. 8A.

The foregoing is illustrative of preferred forms of the invention. Design modifications are clearly encompassed within the principles of the invention as delineated by the terms of the appended claims.

I claim:

1. An adjustable sleeve for adjusting the effective length of the hairs or bristles of artists' paint brushes having a tapered ferrule securing the hairs or bristles to the handle, said adjustable sleeve comprising:

(a) a conical structure having a circumferentially continuous tubular tip and a longitudinally split body extending upwardly from said tip, coaxially therewith, (b) said longitudinally split body defining a relatively narrow slit at its upper portion and a relatively wide cutout at its lower portion, (c) said narrow slit merging into and being continuous with said wide cutout, (d) said tubular tip having a circular cross section, (e) said lower portion of the body having a C-shaped cross-section, and (f) said upper portion of the body having a C-shaped cross-section, (g) said adjustable sleeve being conically tapered from a relatively small diameter at its tubular tip to a relatively large diameter at its longitudinally slit upper body portion to conform to the taper of a paint brush ferrule, (h) the upper body portion of said adjustable sleeve comprising a conical C-clip to grip the paint brush ferrule at selected positions along its length, (i) the length of the adjustable sleeve being sufficient to enable it to fully enclose the paint brush hairs or bristles when the upper body portion of the sleeve is clipped to the lower end of the paint brush ferrule.

2. An adjustable sleeve in accordance with claim 1, said sleeve being made of spring material to enable its upper body portion to grip the paint brush ferrule under spring tension.

3. An adjustable sleeve in accordance with claim 1, wherein a flared lip is provided on the tubular tip at the wide cutout in the lower body portion to guide the brush hairs or bristles into said tubular tip.

4. An adjustable sleeve in accordance with claim 1, wherein the smallest diameter of said upper body portion of the sleeve falling short of the smallest diameter of the paint brush ferrule in the area of engagement between them.

5. An adjustable sleeve for adjusting the effective length of the hairs or bristles of artists' paint brushes having a tapered ferrule securing the hairs or bristles to the handle, said adjustable sleeve comprising:

(a) a conical structure having a circumferentially continuous tubular tip and a longitudinally split body extending upwardly from said tip, coaxially therewith, (b) said longitudinally split body defining a relatively narrow slit at its upper portion and a relatively wide cutout at its lower portion, (c) said narrow slit merging into and being continuous with said wide cutout, (d) said tubular tip having a circular cross-section, (e) said lower portion of the body having a U-shaped cross-section, and (f) said upper portion of the body having a C-shaped cross-section, (g) said adjustable sleeve being conically tapered from a relatively small diameter at its tubular tip to a relatively large diameter at its longitudinally slit upper body portion to conform to the taper of a paint brush ferrule, (h) the upper body portion of said adjustable sleeve comprising a conical C-clip to grip the paint brush ferrule at selected positions along its length, (i) the length of the adjustable sleeve being sufficient to enable it to fully enclose the paint brush hairs or bristles when the upper body portion of the sleeve is clipped to the lower end of the paint brush ferrule.

* * * * *